US009181006B2

(12) United States Patent
Neiner et al.

(10) Patent No.: US 9,181,006 B2
(45) Date of Patent: Nov. 10, 2015

(54) CAN COMPRISING A MAXI-DISPENSE OPENING AND A VENT OPENING

(71) Applicant: Anheuser-Busch InBev S.A., Brussels (BE)

(72) Inventors: Christopher Neiner, Newtown, PA (US); Frank Hellwig, New York, NY (US)

(73) Assignee: Anheuser-Busch InBev S.A., Brussels (BE)

( * ) Notice: Subject to any disclaimer, the term of this patent is extended or adjusted under 35 U.S.C. 154(b) by 0 days.

(21) Appl. No.: 14/370,757

(22) PCT Filed: Dec. 21, 2012

(86) PCT No.: PCT/EP2012/076810

§ 371 (c)(1),
(2) Date: Jul. 3, 2014

(87) PCT Pub. No.: WO2013/102594

PCT Pub. Date: Jul. 11, 2013

(65) Prior Publication Data

US 2014/0367382 A1 Dec. 18, 2014

(30) Foreign Application Priority Data

Jan. 3, 2012 (EP) ..... 12150047

(51) Int. Cl.
*B65D 51/16* (2006.01)
*B65D 17/00* (2006.01)

(52) U.S. Cl.
CPC ..... *B65D 51/1672* (2013.01); *B65D 17/165* (2013.01); *B65D 2517/0014* (2013.01); *B65D 2517/0092* (2013.01); *B65D 2517/0094* (2013.01)

(58) Field of Classification Search
CPC .. B65D 17/165; B65D 17/163; B65D 17/161; B65D 17/16; B65D 51/1672; B21D 51/383; B21D 51/38
USPC ..... 220/271, 272, 270, 266, 265, 906; 413/17, 16, 15, 14, 12
See application file for complete search history.

(56) References Cited

U.S. PATENT DOCUMENTS

| | | | | | |
|---|---|---|---|---|---|
| 3,301,434 | A | * | 1/1967 | Harvey et al. | 220/231 |
| 3,307,737 | A | | 3/1967 | Harvey et al. | |
| 3,326,406 | A | | 6/1967 | Brown | |
| 3,422,983 | A | * | 1/1969 | Rouse | 220/273 |
| 3,618,815 | A | * | 11/1971 | Heffner | 220/269 |
| 3,796,344 | A | * | 3/1974 | De Phillips et al. | 220/269 |
| 4,213,538 | A | | 7/1980 | Boardman | |
| 5,011,037 | A | * | 4/1991 | Moen et al. | 220/271 |
| 5,397,014 | A | | 3/1995 | Aydt | |

(Continued)

FOREIGN PATENT DOCUMENTS

| | | |
|---|---|---|
| CA | 2 280 461 | 11/2001 |
| JP | 05-178345 | 11/1993 |

(Continued)

*Primary Examiner* — Robert J Hicks
(74) *Attorney, Agent, or Firm* — Levy & Grandinetti

(57) ABSTRACT

A can for containing a liquid has a top end. The top end has a dispense area defined on the top end by a first score line and a vent area defined on the top end by a second score line separate from the first score line. The top end has a first rivet located between the vent and dispense areas for coupling to the top end. The top end has a pull tab suitable for puncturing the dispense areas to open a dispense aperture. The top end has a device for opening the vent aperture. The dispense area has a dimension along the diameter of the top end passing by the first rivet greater or equal to the radius of the top end.

20 Claims, 2 Drawing Sheets

(56) References Cited

U.S. PATENT DOCUMENTS

| | | | |
|---|---|---|---|
| 5,494,184 | A | 2/1996 | Noguchi et al. |
| 5,695,085 | A | 12/1997 | Hadener |
| 2003/0098306 | A1 | 5/2003 | Cho |
| 2010/0018976 | A1 | 1/2010 | Christian et al. |
| 2011/0056946 | A1 | 3/2011 | Emanuele, III. et al. |

FOREIGN PATENT DOCUMENTS

| | | |
|---|---|---|
| WO | WO 2004/035399 | 4/2004 |
| WO | WO 2008/023983 | 2/2008 |
| WO | WO 2008/034801 | 3/2008 |
| WO | WO 2009/078738 | 6/2009 |
| WO | WO 2010/046516 | 4/2010 |

* cited by examiner

CAN COMPRISING A MAXI-DISPENSE OPENING AND A VENT OPENING

This Application is the U.S. National Phase of International Application Number PCT/EP2012/076810 filed on Dec. 21, 2012, which claims priority to European Patent Application No. 12150047.4 filed on Jan. 3, 2012.

TECHNICAL FIELD

The present invention relates to the field of cans for containing a liquid. In particular, it concerns beverage cans, such as beer, soda, tonic and the like, allowing a high and homogeneous dispensing rate.

BACKGROUND FOR THE INVENTION

Beverage cans have been on the market for several decades, undergoing a series of evolutions, such as the progressive passage from a "detachable pull tab," wherein a closed loop scored section is coupled to a ring tab, to a "push-in tab" type, wherein no element is detached from the can upon opening. Since in both instances an actuating end of a tab must be pulled off the plane formed by the can top end to open a dispense area, such tabs are herein referred to indiscriminately as "pull tabs".

Rapidly, it appeared that cans comprising a single, dispense aperture lead to a limited dispensing rate and, in particular, to gurgling of the beverage, due to the difficulty for such systems to balance the pressures inside and outside the can upon dispensing. It has been found that providing the can top with a second, vent aperture, spaced apart from the dispense aperture, yielded a much smoother flow of the liquid out of the can, since the pressure inside the can could instantly adapt to the ambient pressure through said vent aperture. Many two-opening can systems were proposed in the art with widely differing opening mechanisms.

U.S. Pat. No. 4,213,538 proposes a can having a can top provided with two score lines forming closed loops defining two areas to be pushed in with a finger or an external tool. An alternative solution is to fix a pull tab to a rivet located between two areas defined by score lines, such that the tab can be tilted both ways to push a first and then a second areas inside the can like a seesaw such as disclosed in U.S. Pat. No. 5,695,085 or U.S. Pat. No. 5,397,014. In some cases, a single pull tab is first pulled up to push in the dispensing area and then pushed back to its initial position and further down to press in the vent area, such as in US2010/0018976, US2011/0056946, WO2009/078738. These systems, however, have the problem that the vent can be accidentally opened in case a pressure is applied onto the tab. To solve this problem, it has been proposed to not align the first and second apertures with the rivet coupling the tab to the can top. This way, after opening the dispensing opening the pull tab must be swiveled about the rivet axis by the corresponding offsetting angle to face the vent area and only then pushed down to press the vent area inside the can such as disclosed in WO2008/023983. In an alternative embodiment, the actuating end of a tab is first pulled up to open the dispense aperture, then swiveled 180° to face the diametrically opposed vent area, the actuating end is pulled up again to open the vent aperture the same way the dispensing aperture was opened, as in U.S. Pat. No. 5,494,184. WO2010/046516 discloses a can comprising a main pull tab and a secondary lever, both fixed to the can top by a single rivet, wherein the secondary lever is brought into puncturing position upon lifting the main pull tab to puncture the dispense area, whereafter the main tab is brought back to its original position, with the secondary lever brought into puncturing position in front of the vent area, which is opened by pressing further down the main pull tab. This system allows to prevent any accidental opening of the vent. All these systems have in common that several movements are required to open both dispense and vent openings, which is rather inconvenient, in particular when the user has only one hand free to open a can.

Solutions for opening both dispense and vent apertures in a single movement have been proposed in the art. U.S. Pat. No. 3,307,737 discloses a single pull tab coupled to a dispense and a vent areas each forming a closed loop. By pulling one free end of the pull tab, the vent is first pulled off the top can, followed by the dispense area. The inconvenient of this rather old system is well known, in that it generates waste which generally ends on the ground and represents both an ecological threat and a source of injuries. CA2280461 proposes to couple with a rivet the ring end of a pull tab to a vent score line forming a closed loop. By pulling up said ring end to puncture the dispense area, the vent area is pulled off the can top. This system has the inconvenient that a strong force is needed to pull off the vent area from the can top with no leverage offered by said design. US2003/0098306 proposes an improvement to the foregoing system by providing a second lever hinged to the main pull tab at the level of the rivet of the vent area, so that the main pull tab is pulled by pulling the second lever, thus yielding a higher couple. WO2004/035399 and U.S. Pat. No. 3,326,406 disclose systems wherein a single pull tab is coupled to the can top with a first rivet and to a vent area with a second rivet. Unlike the preceding systems, here both dispense and vent areas are pushed into the can by pulling up the pull tab at a point forming a triangle with the first and second rivets forming acute angles. The leverage is provided by the altitude of the triangle intersecting the line between the two rivets.

All these efforts to include a vent aperture which can be opened as easily as possible, solved the problem of gurgling and increased the dispensing rate to about 5 l/min, which is about the double of the flow rate obtained with a single aperture can.

The present invention provides a can allowing to increase even further the dispensing rate.

SUMMARY OF THE INVENTION

The present invention is defined in the appended independent claims. Preferred embodiments are defined in the dependent claims. In particular, the present invention concerns a can for containing a liquid and comprising a top end, said top end comprising:

(a) A dispense area defined on said top end by a first score line, (b) A vent area defined on said top end by a second score line (31B) separate from the first score line, (c) A first rivet located between the vent and dispense areas, for coupling to the top end, (d) A pull tab suitable for puncturing the dispense areas (3A) to open a dispense aperture;

(e) Means for opening the vent aperture;

Characterized in that, the dispense area has a dimension (d) along the diameter of the top end passing by the first rivet greater or equal to the radius (R) of the top end.

This geometry permits to increase the area of the dispensing opening, whilst still profiting of the advantages provided by a vent opening. To prevent the generation of litter, it is preferred that no element of the can is detached from the main body upon use of a can. This can be achieved, for example, by ensuring that the first and/or second score lines form an open loop, such that upon lifting the actuating end of the pull tab the dispense area and/or vent area are bent about a line defined between the two open ends of the respective score lines. Alternatively, the first and/or second score lines may form a closed loop but it should then comprise a section of much shallower score than the rest of the score line, such that upon lifting the actuating end of the pull tab the dispense area and/or vent area are bent about a line defined by the shallow score line section.

It is preferred that both dispense and vent apertures can be opened in a single movement of the pull tab. This can be achieved by the solutions disclosing single move opening systems revised in the Background art section supra. Alternative solutions are, however, preferred. For example, the means for opening the vent aperture may comprise a secondary lever coupled to the top end by a second rivet, said secondary lever comprising a puncturing end suitable for puncturing the vent area to open a vent aperture upon lifting an opposite, actuating end of said secondary lever away from the top end, and wherein the secondary lever and pull tab are interlocked such that the lifting of the actuating end of the pull tab triggers the lifting of the actuating end of the secondary lever thus yielding the opening of both dispensing and vent apertures in a single move.

In an alternative solution to open both dispense and vent apertures in a single movement, the vent area is located on the opposite side of the rivet than the dispense area, and the first and second score lines are separated from one another by at least one torsion stripe of the can top material suitable for acting as a hinge by torsion upon lifting the actuating end of the pull tab away from the can top, such that as the dispense aperture is being opened by pushing the dispense area into the interior of the can, a vent aperture is opened by pulling the vent area outwards from the can top end, thus yielding the opening of both dispensing and vent apertures in a single move. In a preferred embodiment, the first and second score lines are substantially in the shape of two Ω's facing each other by their open sides, the rivet being located between them, the torsion stripe being defined by the area separating the substantially straight legs of the opposed Ω's, and wherein the curved portion of the Ω of the second score line which defines the vent area is substantially smaller than the curved portion of the Ω of the first score line which defines the dispense area. The second score line defining the vent area may be deeper than the first score line defining the dispense area to facilitate the opening of the vent aperture, without unduly increasing the force required to lift the pull tab compared with a traditional single aperture can.

Alternatively, the opening of the dispense and vent apertures can be performed in more than one movement, preferably in two movements. For example, as proposed in WO2010/046516 the opening of the second, vent aperture may be performed by a secondary lever mounted on the same rivet as the pull ring, the piercing end of the secondary lever being brought in contact with the second vent area by first lifting the pull tab to press open upon the dispense area followed by pushing the pull tab back to its initial position. At this point the piercing end of the secondary lever is sandwiched between the pull tab and the vent area, and the latter can be pressed inside the can by pressing further down the main pull tab.

A can according to the present invention is particularly suitable for containing and dispensing a beverage selected from the group of alcoholic or non-alcoholic beer or other fermented beverages, soda, tonic, juice, energetic beverages, soup, long drink. Such cans are preferably made of aluminium, an aluminium alloy or tin plated steel.

BRIEF DESCRIPTION OF THE FIGURES

For a fuller understanding of the nature of the present invention, reference is made to the following detailed description taken in conjunction with the accompanying drawings in which.

DETAILED DESCRIPTION OF THE INVENTION

Figure 1:
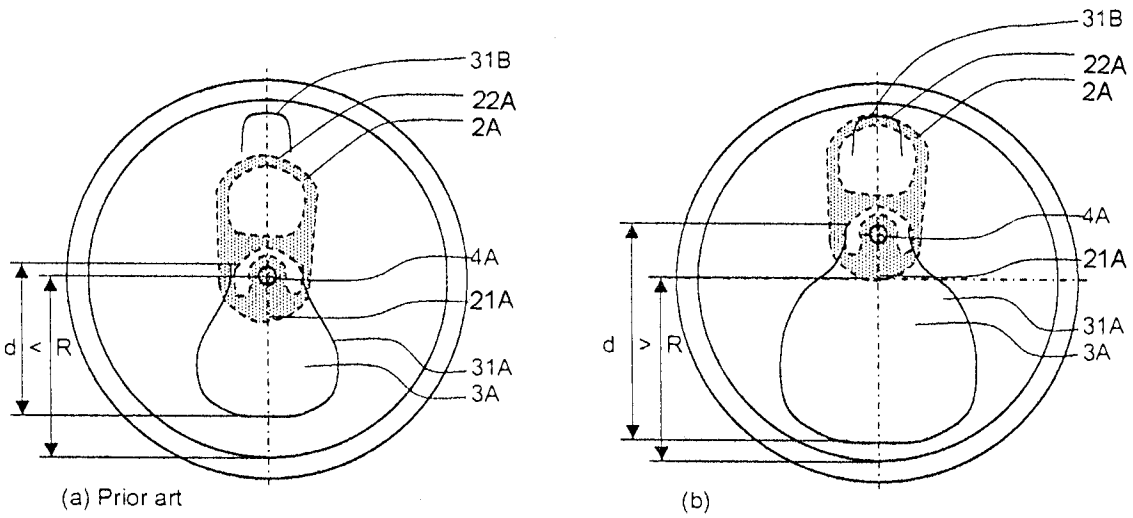
FIG. 1: shows a top view of a can top of (a) a prior art double aperture can and (b) a can according to the present invention.

As can be seen in FIG. 1, a can according to the present invention comprises a top end like traditional cans available in shops to date, with a dispense area (3A) defined on said top end by a first score line (31A), and a pull tab (2A) coupled to the top end by a first rivet (4A). The pull tab (2A) comprises a puncturing end (21A) overlapping the dispense area and an opposite actuating end (22A) which, upon lifting away from the plane of the can top end presses the puncturing end (21A) against the dispense area, breaking the score line and pushing the dispense area into the can, thus opening the dispense aperture (13A). It is of course much preferable that upon opening the dispense aperture (13A), neither the pull tab (2A) nor the dispense area (3A) are separated from the can top end. This can be achieved either by not closing the path formed by the first score line (31A) or by providing a portion of said first line with a shallower score (i.e., less deep) than the rest of the outline. By either of these ways, upon pressing the puncturing end (21A) of the pull tab against the dispense area (3A), the latter will fold about a line between the two ends of the open loop score line, or about the shallower portion of the score line.

The vent area (3B) is defined by a second score line (31B), and is located on the can top end generally located opposite the dispense area (3A) with respect to the rivet (4A). The vent area (3B) should most preferably not be separated from the can top end upon opening the vent aperture. Like for the dispense area (3A) discussed supra the score line (31B) defining the vent area (3B) should define an open path, or comprise a portion of shallower score, to allow the folding of the vent area (3B) about said unscored or shallow scored line portion. The vent area (3B) is generally smaller in size than the dispense area (3A), since the former needs only to ensure pressure balance during dispensing of the liquid out of the can, and a smooth depressurization upon opening of the can.

Apart from a few embodiments, the rivet (4A) coupling the main pull tab (2A) to the can top end is traditionally located at the geometric centre of the can top end. This is particularly true for can comprising both dispensing and vent areas, since the two apertures are generally located on either side of the rivet. There are, of course some exceptions, such as in WO2004/035399 which discloses a can comprising two apertures which can be opened in a single movement of a single pull tab coupled to the top end of the can by two rivets, none being at the centre thereof. The area of the can top available for providing a dispense area is therefore generally limited to half of the can top end area and, consequently, the size of the dispense aperture (13A) is limited accordingly. The present invention solves this problem quite simply by offsetting the rivet (4A) with respect to the can top end, but, unlike in WO2004/035399, the dispense area in a can according to the present invention has a dimension (d) along the diameter of the top end passing by the first rivet (4A) greater or equal to the radius (R) of the top end. This simple solution permits to enlarge the area available for locating the dispense area, which size can be increased accordingly. With a dispensing area of larger area, together with a vent aperture, the flow is both more homogeneous (no gurgling) and faster, allowing to empty a can very rapidly. For beer applications, a large area is advantageous as it allows to better control the formation of foam, without excess as can happen with turbulences often created with smaller apertures.

Contrary to what could be expected, there is no particular problem for locating the vent area opposite the dispense aperture with respect to the first, offset rivet (4A) and it is even possible to apply a single move opening system for the opening of both dispense and vent apertures (13A, 13B).

Figure 2:
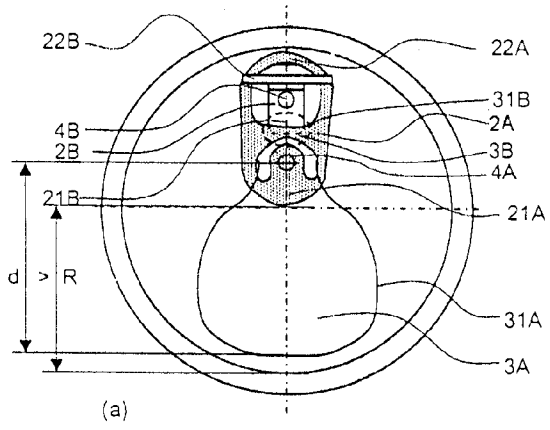
FIG. 2: shows a first embodiment of one move opening system for both dispense and vent apertures applied to the present invention (a) top view, (b) perspective view.
Figure 2:
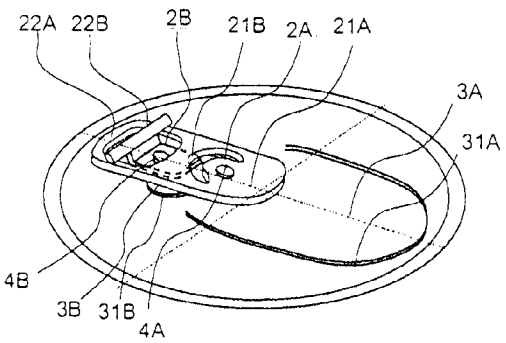

For example, in a first embodiment illustrated in FIG. 2, opening of the vent aperture can be ensured by a secondary lever coupled to the top end by a second rivet (48). As illustrated in FIG. 2(*a*), the first and second rivets (4A, 4B) and dispense and vent areas (2A, 2B) are preferably substantially aligned on a diameter of the can top end, in a sequence (a) dispense area (3A), (b) first rivet (4A), (c) vent area (3B) and (d) second rivet (4B). The secondary lever (2B) has an actuating end (22B) and an opposed puncturing end (21B) overlapping the vent area (3B), such that upon lifting of the actuating end (22B) of the secondary lever (2B), the puncturing end (21B) thereof applies a pressure against the vent area (3B) capable of breaking the second score line (31B) to push and fold the vent area (3B) into the can.

Instead of actuating the pull tab (2A) to open the dispense aperture separately from the secondary lever (2B) to open the vent aperture, and thus require at least two moves to open both apertures, in the present embodiment the secondary lever (3B) is interlocked with the pull tab (3A) such that the lifting of the actuating end (22A) of the pull tab triggers the lifting of the actuating end (22B) of the secondary lever (2B) thus yielding the opening of both dispensing and vent apertures (13A, 13B) in a single move.

The interlocking of the secondary lever (2B) and pull tab (2A) can be achieved by providing the actuating end (22A) of the pull tab (2A) with an opening—such as is often present in pull tabs of traditional single aperture cans—and slide the secondary lever (2B) through said opening such that the actuating end (22B) of the secondary lever (2B) rests on top of the pull tab (2A), whilst the puncturing end (21B) and second rivet (4B) of said secondary lever (2B) are positioned below the pull tab (2A). With this configuration, the lifting up of the pull tab (2A) to open the dispense aperture drives upwards the actuating end (22B) of the secondary lever (2B) resting and sliding on an edge of the rising opening of the pull tab as it is being lifted. The secondary lever (2B), fixed to the can top end by the second rivet (4B) is thus tilted pressing the puncturing end (21B) down against the vent area (3B) until the second score line (31B) breaks to open the vent aperture.

In a preferred embodiment of the above arrangement illustrated in FIG. 2, the secondary lever (2B) is in the shape of a plate extending between a first and second substantially parallel planes substantially parallel to the plane defined by the can top end, with a first, puncturing portion comprising the puncturing end (21B) and extending along said first plane, and a second, actuating portion comprising the actuating end (21B) and extending substantially along said second plane, the first, puncturing portion comprising a hole for receiving the second rivet (4B). The distance between the two planes is substantially equal to the distance between the top surface of the pull tab (2A) and the can top end surface. The actuating end (22B) of the secondary lever (2B) can be planar and resting on top of the main pull tab (4A) or, as illustrated in FIG. 2(*b*) in the shape of a pin extending parallel to the can top end and resting on the top surface of the main pull tab. With this geometry, the actuating portion of the secondary lever (2B) can rest on top of the pull tab (2A) and the puncturing portion of the secondary lever (2B) can lie on the surface of the can top end.

Figure 3:
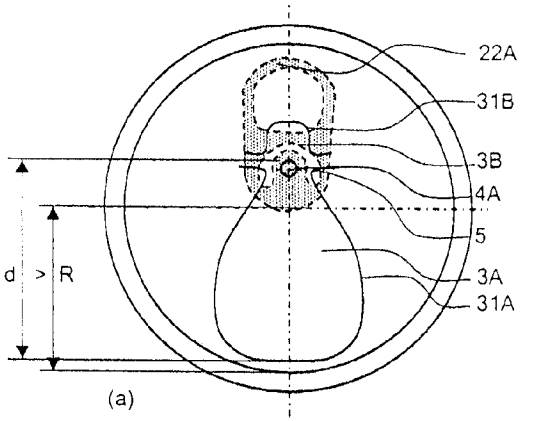
FIG. 3: shows a second embodiment of one move opening system for both dispense and vent apertures applied to the present invention (a) top view, and side cut view in (b) closed and (c) open positions.

In a second embodiment, illustrated in FIG. 3, opening of the vent aperture (13B) is possible by the torsion or bending of a torsion stripe (5) upon lifting the actuating end (22A) of the main pull tab (2A). In this embodiment, a single pull tab (4A) is coupled to the can top end with a single rivet (4A) and is used to open both dispense and vent apertures (13A, 13B) in a single movement of the pull tab. The first and second score lines (31A, 31B) are separated from one another by an area of the can top material defining at least one torsion stripe (5) suitable for acting as a hinge by torsion upon lifting the actuating end (22A) of the pull tab (2A) away from the can top end. As illustrated in FIGS. 3(*a*)&(*b*), the actuating end (22A) of the pull tab (2A) is lifted, the puncturing end located opposite thereof with respect to the rivet (4A) presses onto the dispense area (3A), breaking the score line (31A) and pushing the dispense area (13A) into the interior of the can. The tilting of the pull tab about the rivet creates a moment of torsion in the area of the can top end comprising the rivet, which results in a tilting of the rivet itself with respect to the plane defined by the can top end. By creating an appropriate torsion stripe (5) at or around the rivet, the moment of torsion acting in the area around the rivet can be taken advantage of to create an upward lifting force capable of breaking the second score line (31B) and to lift the vent area (3B) away from the can top end to open the vent (13B) (cf. FIGS. 3(*b*)&(*c*)).

The dispense area (3A), the rivet (4A), and the vent area (3B) are preferably aligned on a first diameter of the can top end in this order. The at least one torsion stripe (5), acting as a hinge about which the rivet (4A) can tilt, may generally be substantially normal to said first diameter. Since the rivet coupling the pull tab (2A) to the can top end defines an area of higher bending stiffness, pulling the actuating end (22A) of the pull tab (2A)—which is sandwiched between the can top end and the head of the rivet (4A)—is necessarily accompanied by some tilting of the rivet and by the creation of a bending field in the can top end surrounding it. The creation of a torsion stripe (5) of lower bending stiffness increases the difference in bending stiffness between the rivet area and the area surrounding it, allowing to increase the magnitude of the bending field behind the rivet area with respect to the dispense area (3A). To further enhance the hinge effect, the torsion stripe (5) may be provided with secondary score lines, which are much shallower than the first and second score lines (31A, 31B) since they are not intended to break but only to facilitate bending of the stripe. By designing the first and second score lines properly, however, secondary score lines are not necessary to yield the desired hinge effect.

In order to further facilitate the opening of the vent aperture (13B), the second score line (31B) defining the vent area (3B) may be deeper than the score line (31A) defining the dispense area (3A). This way, less force is required to break the second score line (31B), and since the vent area (3B) is generally substantially smaller than the dispense area (3A), the force applied by the pressurized gas inside the can to the second score line is lower than the one applied on the dispense area, thus reducing the risk of accidental blowing of the vent area.

The first and second embodiments presented supra allow the provision of a vent aperture (13B) which combined opening with the dispense aperture (13A) can be triggered by the same single move as has been used by generations of consumers with traditional single aperture cans. Contrary to the solution proposed in CA2280461, the force required to open both openings is not much different from the one required to open traditional single aperture cans, because the geometry of the opening system of the present invention allows for a substantial leverage effect. With the present invention it is therefore possible to combine the advantages of a vent aperture, a single move opening system, and a large dispense area allowing the dispense rate to be increased and homogenized accordingly.

Different opening systems can be implemented to a can according to the present invention; if the two apertures cannot be opened with a single movement, there are interesting two-move opening systems which can easily be applied to the present invention. For example, the system disclosed in WO2010/046516, which disclosure is incorporated herein by reference. The single rivet coupling both main tab and secondary lever need only be offset with respect to the centre of the can top end to permit a larger dispense area (3A) to be defined, thus increasing the dispensing efficacy.

A can according to the present invention is particularly suitable for containing beverages. For example, alcoholic or non-alcoholic beer or other fermented beverages, such as cider, low malt content beer like beverages, sparkling wine, and the like, soda, tonic, juice, energetic beverages, premixed long drinks of a spirit and a soda, milk, condensed milk, soup, sauce, and the like. The can may be made of aluminium, an aluminium alloy or tin plated steel.

The invention claimed is:

1. A can for containing a liquid comprising a top end, said top end comprising:

(a) a dispense area defined on said top end by a first score line, (b) a vent area defined on said top end by a second score line separate from the first score line, (c) a first rivet located between the vent and dispense area for coupling to the top end, (d) a pull tab comprising an actuating end, said pull tab being suitable for puncturing the dispense area to open a dispense aperture by lifting said actuating end, and (e) a device for opening a vent aperture;

wherein the dispense area has a dimension (d) along a diameter of the top end passing by the first rivet greater or equal to a radius (R) of the top end.

2. The can according to claim 1, wherein the first and/or second score lines form an open loop, such that upon lifting the actuating end of the pull tab the dispense area and/or vent area are bent about a line defined between two open ends of each of the open loops formed by the respective score lines.

3. The can according to claim 1, wherein the first and/or second score lines form a closed loop comprising a section of much shallower score than the rest of the score line, such that upon lifting the actuating end of the pull tab, the dispense area and/or vent area are bent about a line defined by the shallow score line section.

4. The can according to claim 1, wherein the dispense aperture and vent aperture can be opened in a single movement of the pull tab.

5. The can according to claim 4, wherein the device for opening the vent aperture comprise a secondary lever coupled to the top end by a second rivet, said secondary lever comprising a puncturing end suitable for puncturing the vent area to open the vent aperture upon lifting an opposite, actuating end of said secondary lever away from the top end, and wherein the secondary lever and pull tab are interlocked such that the lifting of the actuating end of the pull tab triggers the lifting of the actuating end of the secondary lever thus yielding the opening of both dispensing and vent apertures in a single move.

6. The can according to claim 4, wherein the vent area is located on the opposite side of the rivet than the dispense area, and the first and second score lines are separated from one another by at least one torsion stripe of the can top material suitable for acting as a hinge by torsion upon lifting the actuating end of the pull tab away from the can top, such that as the dispense aperture is being opened by pushing the dispense area into the interior of the can, the vent aperture is opened by pulling the vent area outwards from the can top end.

7. The can according to claim 6, wherein the first and second score lines are substantially in the shape of two Ω's facing each other by their open sides, the rivet being located between them, the torsion stripe being defined by the area separating the substantially straight legs of the opposed Ω's, and wherein the curved portion of the Ω of the second score line which defines the vent area is substantially smaller than the curved portion of the Ω of the first score line which defines the dispense area.

8. The can according to claim 4, wherein the second score line defining the vent area is deeper than the first score line defining the dispense area.

9. The can according to claim 1, wherein the opening of the second, vent aperture is performed by a secondary lever mounted on the same rivet as the pull tab, a puncturing end of the secondary lever being brought in contact with the second vent area by first lifting the pull tab to press open upon the dispense area followed by pushing the pull tab back to its initial position, with the puncturing end of the secondary lever sandwiched between the pull tab and the vent area, the latter being pressed inside the can by pressing further down the pull tab.

10. The can according to claim 9, wherein a liquid contained therein is a beverage selected from the group of alcoholic or non-alcoholic beer or other fermented beverages, soda, tonic, juice, energetic beverages, soup, long drink.

11. The can according to claim 10 made of aluminum, an aluminum alloy or tin plated steel.

12. The can according to claim 5, wherein the second score line defining the vent area is deeper than the first score line defining the dispense area.

13. The can according to claim 6, wherein the second score line defining the vent area is deeper than the first score line defining the dispense area.

14. The can according to claim 7, wherein the second score line defining the vent area is deeper than the first score line defining the dispense area.

15. The can according to claim 2, wherein the device for opening the vent aperture comprises a secondary lever coupled to the top end by a second rivet, said secondary lever comprising a puncturing end suitable for puncturing the vent area to open the vent aperture upon lifting an opposite, actuating end of said secondary lever away from the top end, and wherein the secondary lever and pull tab are interlocked such that the lifting of the actuating end of the pull tab triggers the lifting of the actuating end of the secondary lever thus yielding the opening of both dispensing and vent apertures in a single move.

16. The can according to claim 15, wherein a liquid contained therein is a beverage selected from the group of alcoholic or non-alcoholic beer or other fermented beverages, soda, tonic, juice, energetic beverages, soup, long drink.

17. The can according to claim 16 made of aluminum, an aluminum alloy or tin plated steel.

18. The can according to claim 3, wherein the device for opening the vent aperture comprises a secondary lever coupled to the top end by a second rivet, said secondary lever comprising a puncturing end suitable for puncturing the vent area to open the vent aperture upon lifting an opposite, actuating end of said secondary lever away from the top end, and wherein the secondary lever and pull tab are interlocked such that the lifting of the actuating end of the pull tab triggers the lifting of the actuating end of the secondary lever thus yielding the opening of both dispensing and vent apertures in a single move.

19. The can according to claim 18, wherein a liquid contained therein is a beverage selected from the group of alcoholic or non-alcoholic beer or other fermented beverages, soda, tonic, juice, energetic beverages, soup, long drink.

20. The can according to claim 19 made of aluminum, an aluminum alloy or tin plated steel.

* * * * *